US008253520B2

(12) United States Patent
Yang

(10) Patent No.: US 8,253,520 B2
(45) Date of Patent: Aug. 28, 2012

(54) MAGNETIC ATTRACTIVE CONJUNCTION MECHANISM OF ROTATING GRIPPER IN CLAMPING DEVICE

(76) Inventor: Tai-Her Yang, Dzan-Hwa (TW)

( * ) Notice: Subject to any disclaimer, the term of this patent is extended or adjusted under 35 U.S.C. 154(b) by 194 days.

(21) Appl. No.: 12/780,081

(22) Filed: May 14, 2010

(65) Prior Publication Data

US 2011/0279204 A1 Nov. 17, 2011

(51) Int. Cl.
*H01F 7/02* (2006.01)

(52) U.S. Cl. ..... 335/306; 335/285; 269/266

(58) Field of Classification Search ..... 335/285–286, 335/302–306; 269/266
See application file for complete search history.

(56) References Cited

U.S. PATENT DOCUMENTS 5,410,924 A * 5/1995 Krasnov ..... 29/426.5
2011/0278781 A1* 11/2011 Yang ..... 269/266
* cited by examiner

*Primary Examiner* — Bernard Rojas
(74) *Attorney, Agent, or Firm* — Bacon & Thomas, PLLC

(57) ABSTRACT

The magnetic attractive conjunction mechanism of rotating gripper in clamping device of the present invention relates to a clamping device with sector type prism rotating gripper clamping various shapes desirable targets, in which magnetic attractive conjunction mechanism is installed between rotary sector type prism rotating gripper and flush socket with sector type recessed cylindrical sliding surface of clip jaw for coupling to prevent from detachment.

18 Claims, 6 Drawing Sheets

MAGNETIC ATTRACTIVE CONJUNCTION MECHANISM OF ROTATING GRIPPER IN CLAMPING DEVICE

BACKGROUND OF THE INVENTION (a) Field of the Invention

The magnetic attractive conjunction mechanism of rotating gripper in clamping device of the present invention relates to a clamping device with sector type prism rotating gripper clamping various shapes desirable targets, in which magnetic attractive conjunction mechanism is installed between rotary sector type prism rotating gripper and flush socket with sector type recessed cylindrical sliding surface of clip jaw for coupling to prevent from detachment.

(b) Description of the Prior Art

For the conventional clamping device with sector type cylinder-shaped gripper, between the sector type cylinder-shaped gripper and the sector type flush socket with recessed cylindrical sliding surface, the limited structure is usually constituted by the limited pin and chute, but the production is more difficult, and the cleaning and maintenance for the coupling surface is hard.

SUMMARY OF THE INVENTION

The magnetic attractive conjunction mechanism of rotating gripper in clamping device of the present invention relates to clamping device with sector type prism rotating gripper, in which magnetic attractive conjunction mechanism is installed between the sector type cylinder-shaped rotating gripper installed at the clip jaw of the clamping device and the sector type flush socket with recessed cylindrical sliding surface, to attract and connect the sector type cylinder-shaped rotating gripper and the sector type flush socket with recessed cylindrical sliding surface, the arcuate coupling surface of the sector type flush socket with recessed cylindrical sliding surface in the clip jaw are coaxial with the rotating axis of the sector type cylinder-shaped rotating gripper, their cylindrical arc surfaces are sliding and tight contact to form a coupling surface, and the circular arcuate back of sector type cylinder-shaped rotating gripper rotates along the arcuate coupling surface of the flush socket with sector type recessed cylindrical sliding surface in the clip jaw to withstand the pressure of the gripped object, thus the side gripping surface of the sector type cylinder-shaped rotating gripper against the gripped object is at steady-state.

DESCRIPTION OF MAIN COMPONENT SYMBOLS

Figure 1:
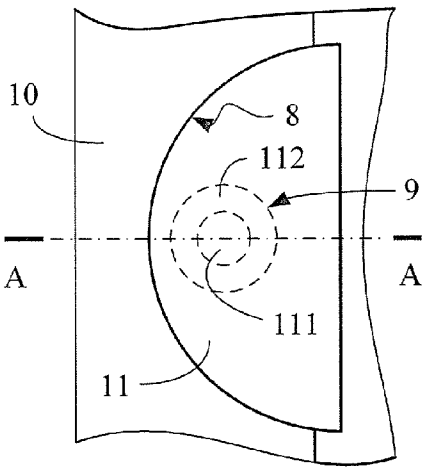
FIG. 1 is a schematic top view showing the operational coupled structure by way of the magnetic attractive conjunction mechanism made of permanent magnet installed between the rotary sector type prism rotating gripper and the flush socket with sector type recessed cylindrical sliding surface in the clip jaw, according to the present invention.

8, 108: Flush socket with sector type recessed cylindrical sliding surface
9, 109: Shrinkage pool
10, 100: Clip jaw
11, 101: Sector type prism rotating gripper
15: Cover type magnetic circuit
20: Horseshoe magnet
111: Magnet
112: Non-magnetizer
119: Spiral hole

DETAILED DESCRIPTION OF THE PREFERRED EMBODIMENTS

For the magnetic attractive conjunction mechanism of rotating gripper in clamping device, the magnetic attractive conjunction mechanism is installed at one or two of the sector type prism rotating gripper and the flush socket with sector type recessed cylindrical sliding surface of the coupled clip jaw, to make the sector type prism rotating gripper attract and connect to the flush socket with sector type recessed cylindrical sliding surface of the clip jaw through magnetic force, so as to form rotary coupling which prevents from detachment and is easily removed for cleaning and maintenance;

If both of the sector type prism rotating gripper and the coupled flush socket with sector type recessed cylindrical sliding surface are installed with magnetic attraction stractures, the maximum attractive force caused from the relative positions between two magnetic attraction stractures with different polarities attraction is used for the positioning function of rotating gripper return.

The definition of the sector of the present invention is an incomplete sector round with an included angle less than 180 degrees and more than 0 degree.

FIG. 1 is a schematic top view showing the operational coupled structure by way of the magnetic attractive conjunction mechanism made of permanent magnet installed between the rotary sector type prism rotating gripper and the flush socket with sector type recessed cylindrical sliding surface in the clip jaw, according to the present invention.

Figure 2:
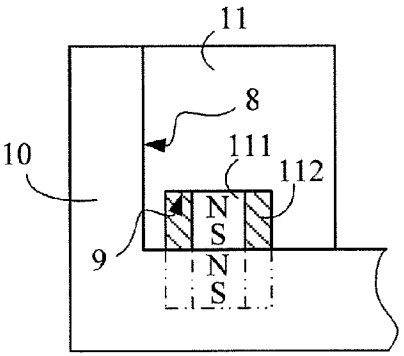
FIG. 2 is the A-A cutaway view of FIG. 1.

FIG. 2 is the A-A cutaway view of FIG. 1.

FIG. 1 and FIG. 2 show structure principle of the magnetic attractive conjunction mechanism of rotating gripper in clamping device, and the main components are as following:

a sector type prism rotating gripper 11, which is installed in a flush socket with sector type recessed cylindrical sliding surface 8 of a clip jaw 10 to make coaxial relative rotation, and their cylindrical arc surfaces are sliding and tight contact to form a coupling surface, in which a shrinkage pool 9 is installed at one or two of the sector type prism rotating gripper 11 and the coupling surface of the flush socket with sector type recessed cylindrical sliding surface 8 of the clip jaw 10, for installing a magnet 111 to make the both attract and connect each other after coupling to form a closed magnetic circuit, and the magnet and the coupling surface are parallel and level, and a non-magnetizer 112 is installed between the circumference of the magnet and the shrinkage pool 9 with larger aperture, to keep connection for the structure of the magnet and the shrinkage pool without interference the magnetic attraction and relative rotation between the both; the above-mentioned setting mode includes keeping through structural combination or gluing.

If both of the sector type prism rotating gripper and the coupled flush socket with sector type recessed cylindrical sliding surface are installed with magnetic attraction stractures, the maximum attractive force caused from the relative positions between two magnetic attraction stractures with different polarities attraction is used for the positioning function of rotating gripper return.

The materials for installing the sector type prism rotating gripper 11 of the magnetic attractive conjunction mechanism or the flush socket with sector type recessed cylindrical sliding surface 8 of the clip jaw 10 are not limited to be magnetic, if the sector type prism rotating gripper 11 or the flush socket with sector type recessed cylindrical sliding surface 8 of the clip jaw 10, which are relatively coupling, are made of magnetic materials, the both are directly coupling and rotating.

If the sector type prism rotating gripper 11 or the flush socket with sector type recessed cylindrical sliding surface 8 of the clip jaw 10, which are relatively coupling, are made of non-magnetic materials, the closed magnetic circuit is formed by one of the following modes, including: 1) magnetic materials additionally installed at the coupling surface along curved track of relative rotation; or 2) magnetic materials additionally installed at the coupling surface along curved track of relative rotation, and magnetic attractive conjunction mechanism further additionally installed.

Figure 3:
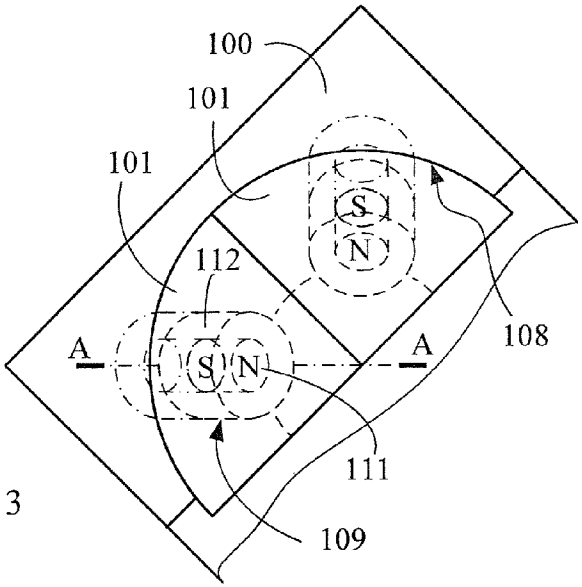
FIG. 3 is the first structural embodiment, in which the flush socket with sector type recessed cylindrical sliding surface in the clip jaw of the present invention is installed with two sector type cylinder-shaped rotating grippers.

FIG. 3 is the first structural embodiment, in which the flush socket with sector type recessed cylindrical sliding surface in the clip jaw of the present invention is installed with two sector type cylinder-shaped rotating grippers.

Figure 4:
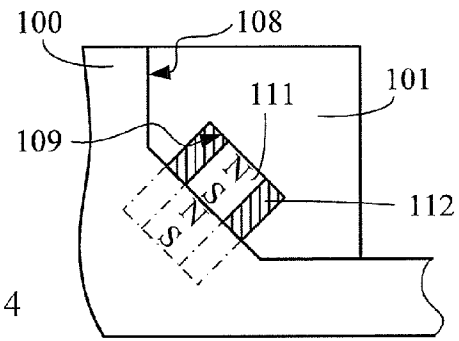
FIG. 4 is the A-A cutaway view of FIG. 3.

FIG. 4 is the A-A cutaway view of FIG. 3.

As shown in FIG. 3 and FIG. 4, in which:

two sector type prism rotating grippers 101 with same radius but same or different included angles are made of magnetic materials, in which the bottom has recessed oblique arc surface, two sector type prism rotating grippers 101 are installed at the same flush socket 108 of the clip jaw 100 with sector type recessed cylindrical sliding surface, which is made of magnetic materials, for coaxial rotary, the bottom of the flush socket with sector type recessed cylindrical sliding surface 108 of the clip jaw 100 also has recessed oblique surface, coordinating with the recessed oblique arc surface of the bottom of the sector type prism rotating gripper 101, to form oblique coupling arc surface, and their cylindrical arc surfaces are sliding and tight contact to form a coupling surface, and the shrinkage pool 109 is installed at one or two of the two sector type prism rotating grippers 101 and the oblique coupling arc surface of the flush socket with sector type recessed cylindrical sliding surface 108 of the clip jaw 100, for installing the magnet 111 to make the both attract and connect each other after coupling to form a closed magnetic circuit, and the magnet and the coupling arc surface are parallel and level, and the non-magnetizer 112 is installed between the circumference of the magnet and the shrinkage pool 109 with larger aperture, to keep connection for the structure of the magnet and the shrinkage pool without interference the magnetic attraction and relative rotation between the both; the above-mentioned setting mode includes keeping through structural combination or gluing.

If both of the sector type prism rotating gripper and the coupled flush socket with sector type recessed cylindrical sliding surface are installed with magnetic attraction stractures, the maximum attractive force caused from the relative positions between two magnetic attraction stractures with different polarities attraction is used for the positioning function of rotating gripper return.

Figure 5:
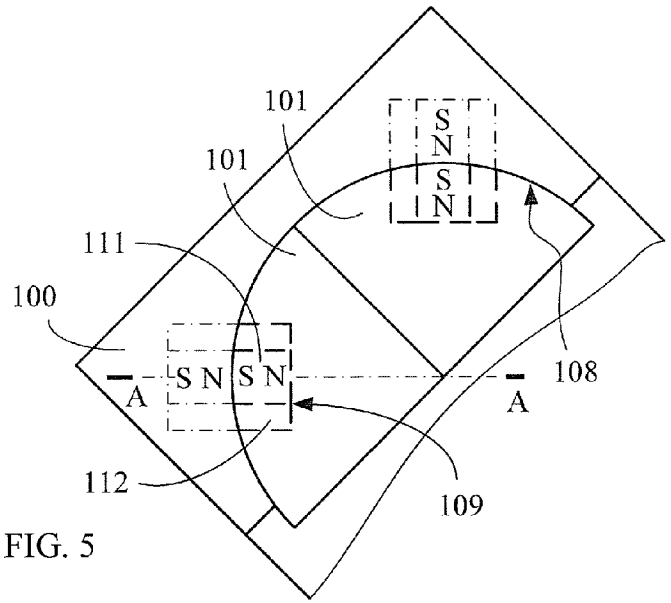
FIG. 5 is the second structural embodiment, in which the flush socket with sector type recessed cylindrical sliding surface in the clip jaw of the present invention is installed with two sector type cylinder-shaped rotating grippers.

FIG. 5 is the second structural embodiment, in which the flush socket with sector type recessed cylindrical sliding surface in the clip jaw of the present invention is installed with two sector type cylinder-shaped rotating grippers.

Figure 6:
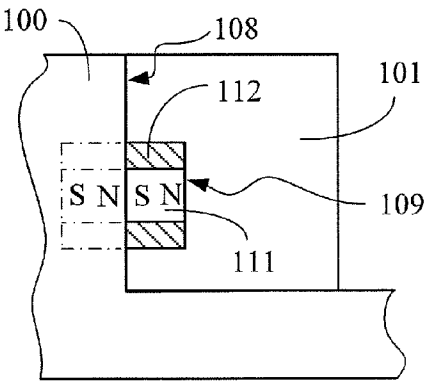
FIG. 6 is the A-A cutaway view of FIG. 5.

FIG. 6 is the A-A cutaway view of FIG. 5.

As shown in FIG. 5 and FIG. 6, in which:

two sector type prism rotating grippers 101 with same radius but same or different included angles are made of magnetic materials, in which the backside has arc surface, two sector type prism rotating grippers 101 are installed at the same flush socket 108 of the clip jaw 100 with sector type recessed cylindrical sliding surface, which is made of magnetic materials, for coaxial rotary, and their cylindrical arc surfaces are sliding and tight contact to form a coupling surface, and the shrinkage pool 109 is installed at one or two of the backside arc surfaces of the two sector type prism rotating grippers 101 and the oblique coupling arc surface of the flush socket with sector type recessed cylindrical sliding surface 108 of the clip jaw 100, for installing the magnet 111 to make the both attract and connect each other after coupling to form a closed magnetic circuit, and the magnet and the coupling arc surface are parallel and level, and the non-magnetizer 112 is installed between the circumference of the magnet and the shrinkage pool 109 with larger aperture, to keep connection for the structure of the magnet and the shrinkage pool without interference the magnetic attraction and relative rotation between the both; the above-mentioned setting mode includes keeping through structural combination or gluing.

If both of the sector type prism rotating gripper and the coupled flush socket with sector type recessed cylindrical sliding surface are installed with magnetic attraction stractures, the maximum attractive force caused from the relative positions between two magnetic attraction stractures with different polarities attraction is used for the positioning function of rotating gripper return.

Figure 7:
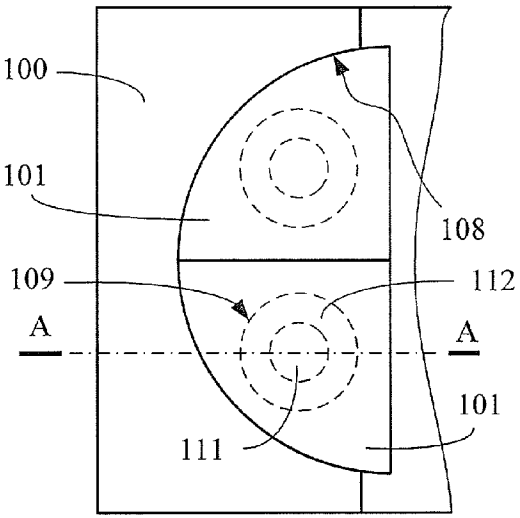
FIG. 7 is the third structural embodiment, in which the flush socket with sector type recessed cylindrical sliding surface in the clip jaw of the present invention is installed with two sector type cylinder-shaped rotating grippers.

FIG. 7 is the third structural embodiment, in which the flush socket with sector type recessed cylindrical sliding surface in the clip jaw of the present invention is installed with two sector type cylinder-shaped rotating grippers.

Figure 8:
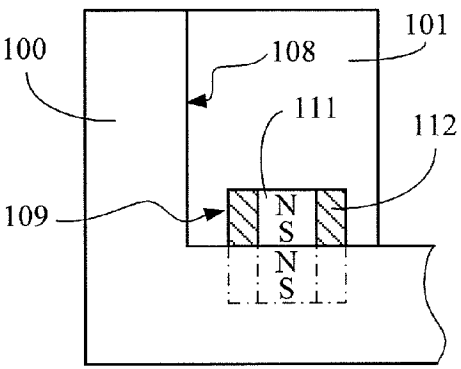
FIG. 8 is the A-A cutaway view of FIG. 7.

FIG. 8 is the A-A cutaway view of FIG. 7.

As shown in FIG. 7 and FIG. 8, in which:

two sector type prism rotating grippers 101 with same radius but same or different included angles are made of magnetic materials, in which two sector type prism rotating grippers 101 are installed at the same flush socket 108 of the clip jaw 100 with sector type recessed cylindrical sliding surface, which is made of magnetic materials, for coaxial rotary, and their cylindrical arc surfaces are sliding and tight contact to form a coupling surface, and the shrinkage pool 109 is installed at one or two of the coupling surfaces of the two sector type prism rotating grippers 101 and the coupling surface of the flush socket with sector type recessed cylindrical sliding surface 108 of the clip jaw 100, for installing the magnet 111 to make the both attract and connect each other after coupling to form a closed magnetic circuit, and the magnet and the coupling arc surface are parallel and level, and the non-magnetizer 112 is installed between the circumference of the magnet and the shrinkage pool 109 with larger aperture, to keep connection for the structure of the magnet and the shrinkage pool without interference the magnetic attraction and relative rotation between the both; the above-mentioned setting mode includes keeping through structural combination or gluing.

If both of the sector type prism rotating gripper and the coupled flush socket with sector type recessed cylindrical sliding surface are installed with magnetic attraction stractures, the maximum attractive force caused from the relative positions between two magnetic attraction stractures with different polarities attraction is used for the positioning function of rotating gripper return.

Figure 9:
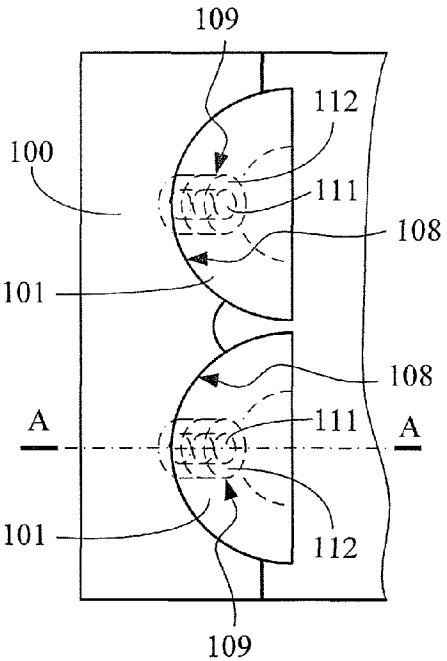
FIG. 9 is the first structural embodiment, in which the clip jaw of the present invention has two flush sockets with sector type recessed cylindrical sliding surfaces, and each flush socket with sector type recessed cylindrical sliding surface is individually installed with a sector type cylinder-shaped rotating gripper.

FIG. 9 is the first structural embodiment, in which the clip jaw of the present invention has two flush sockets with sector type recessed cylindrical sliding surfaces, and each flush socket with sector type recessed cylindrical sliding surface is individually installed with a sector type cylinder-shaped rotating gripper.

Figure 10:
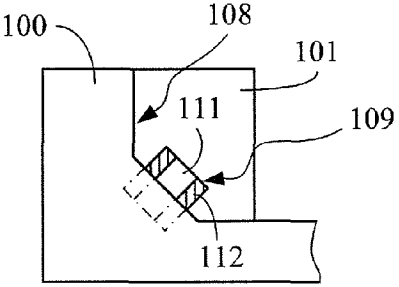
FIG. 10 is the A-A cutaway view of FIG. 9.

FIG. 10 is the A-A cutaway view of FIG. 9.

As shown in FIG. 9 and FIG. 10, in which:

the clip jaw has two flush sockets with sector type recessed cylindrical sliding surfaces, and each flush socket with sector type recessed cylindrical sliding surface is individually installed with a sector type cylinder-shaped rotating gripper, and the sector type prism rotating gripper 101 is made of magnetic materials, in which the bottom has recessed oblique arc surface, the sector type prism rotating gripper 101 is installed at the flush socket with sector type recessed cylindrical sliding surface 108 of the clip jaw 100, which is made of magnetic materials, for coaxial rotary, the bottom of the flush socket with sector type recessed cylindrical sliding surface 108 of the clip jaw 100 also has recessed oblique surface, coordinating with the recessed oblique arc surface of the bottom of the sector type prism rotating gripper 101, to form oblique coupling arc surface, and their cylindrical arc surfaces are sliding and tight contact to form a coupling surface, and the shrinkage pool 109 is installed at one or two of the sector type prism rotating gripper 101 and the oblique coupling arc surface of the flush socket with sector type recessed cylindrical sliding surface 108 of the clip jaw 100, for installing the magnet 111 to make the both attract and connect each other after coupling to form a closed magnetic circuit, and the magnet and the coupling arc surface are parallel and level, and the non-magnetizer 112 is installed between the circumference of the magnet and the shrinkage pool 109 with larger aperture, to keep connection for the structure of the magnet and the shrinkage pool without interference the magnetic attraction and relative rotation between the both; the above-mentioned setting mode includes keeping through structural combination or gluing.

If both of the sector type prism rotating gripper and the coupled flush socket with sector type recessed cylindrical sliding surface are installed with magnetic attraction stractures, the maximum attractive force caused from the relative positions between two magnetic attraction stractures with different polarities attraction is used for the positioning function of rotating gripper return.

Figure 11:
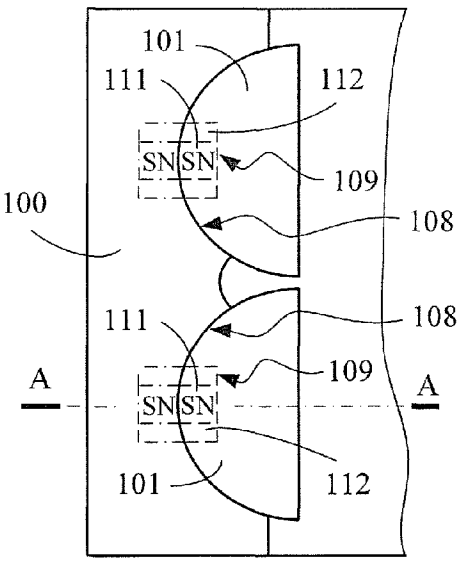
FIG. 11 is the second structural embodiment, in which the clip jaw of the present invention has two flush sockets with sector type recessed cylindrical sliding surfaces, and each flush socket with sector type recessed cylindrical sliding surface is individually installed with a sector type cylinder-shaped rotating gripper.

FIG. 11 is the second structural embodiment, in which the clip jaw of the present invention has two flush sockets with sector type recessed cylindrical sliding surfaces, and each flush socket with sector type recessed cylindrical sliding surface is individually installed with a sector type cylinder-shaped rotating gripper.

Figure 12:
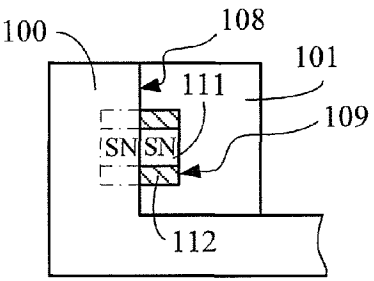
FIG. 12 is the A-A cutaway view of FIG. 11.

FIG. 12 is the A-A cutaway view of FIG. 11.

As shown in FIG. 11 and FIG. 12, in which:

the clip jaw has two flush sockets with sector type recessed cylindrical sliding surfaces, and each flush socket with sector type recessed cylindrical sliding surface is individually installed with a sector type cylinder-shaped rotating gripper, and the sector type prism rotating gripper 101 is made of magnetic materials, in which the backside has arc surface, the sector type prism rotating gripper 101 is installed at the flush socket with sector type recessed cylindrical sliding surface 108 of the clip jaw 100, which is made of magnetic materials, for coaxial rotary, and their cylindrical arc surfaces are sliding and tight contact to form a coupling surface, and the shrinkage pool 109 is installed at one or two of the backside arc surface of the sector type prism rotating gripper 101 and the coupling arc surface of the flush socket with sector type recessed cylindrical sliding surface 108 of the clip jaw 100, for installing the magnet 111 to make the both attract and connect each other after coupling to form a closed magnetic circuit, and the magnet and the coupling arc surface are parallel and level, and the non-magnetizer 112 is installed between the circumference of the magnet and the shrinkage pool 109 with larger aperture, to keep connection for the structure of the magnet and the shrinkage pool without interference the magnetic attraction and relative rotation between the both; the above-mentioned setting mode includes keeping through structural combination or gluing.

If both of the sector type prism rotating gripper and the coupled flush socket with sector type recessed cylindrical sliding surface are installed with magnetic attraction stractures, the maximum attractive force caused from the relative positions between two magnetic attraction stractures with different polarities attraction is used for the positioning function of rotating gripper return.

Figure 13:
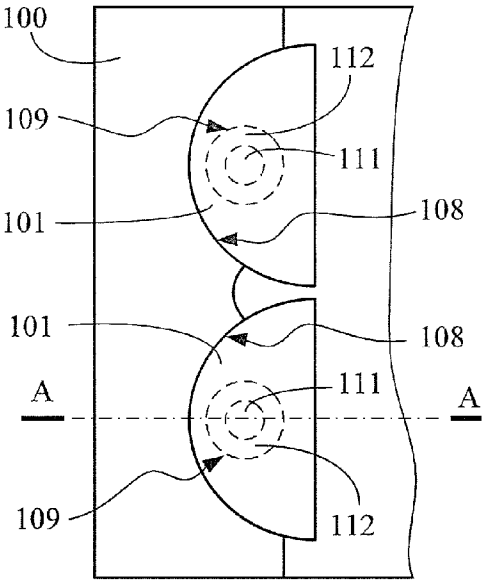
FIG. 13 is the third structural embodiment, in which the clip jaw of the present invention has two flush sockets with sector type recessed cylindrical sliding surfaces, and each flush socket with sector type recessed cylindrical sliding surface is individually installed with a sector type cylinder-shaped rotating gripper.

FIG. 13 is the third structural embodiment, in which the clip jaw of the present invention has two flush sockets with sector type recessed cylindrical sliding surfaces, and each flush socket with sector type recessed cylindrical sliding surface is individually installed with a sector type cylinder-shaped rotating gripper.

Figure 14:
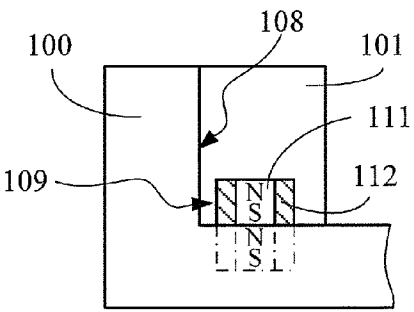
FIG. 14 is the A-A cutaway view of FIG. 13.

FIG. 14 is the A-A cutaway view of FIG. 13.

As shown in FIG. 13 and FIG. 14, in which:

the clip jaw has two flush sockets with sector type recessed cylindrical sliding surfaces, and each flush socket with sector type recessed cylindrical sliding surface is individually installed with a sector type cylinder-shaped rotating gripper, and the sector type prism rotating gripper 101 is made of magnetic materials, in which the sector type prism rotating gripper 101 is installed at the flush socket with sector type recessed cylindrical sliding surface 108 of the clip jaw 100, which is made of magnetic materials, for coaxial rotary, and their cylindrical arc surfaces are sliding and tight contact to form a coupling surface, and the shrinkage pool 109 is installed at one or two of the coupling surface of the bottom of the sector type prism rotating gripper 101 and the coupling surface of the flush socket with sector type recessed cylindrical sliding surface 108 of the clip jaw 100, for installing the magnet 111 to make the both attract and connect each other after coupling to form a closed magnetic circuit, and the magnet and the coupling arc surface are parallel and level, and the non-magnetizer 112 is installed between the circumference of the magnet and the shrinkage pool 109 with larger aperture, to keep connection for the structure of the magnet and the shrinkage pool without interference the magnetic attraction and relative rotation between the both; the above-mentioned setting mode includes keeping through structural combination or gluing.

If both of the sector type prism rotating gripper and the coupled flush socket with sector type recessed cylindrical sliding surface are installed with magnetic attraction stractures, the maximum attractive force caused from the relative positions between two magnetic attraction stractures with different polarities attraction is used for the positioning function of rotating gripper return.

For the magnetic attractive conjunction mechanism of rotating gripper in clamping device, the magnetic attractive conjunction mechanism for the sector type prism rotating gripper 11 attracting and connecting the flush socket with sector type recessed cylindrical sliding surface 8 of the clip jaw 10 is further constituted by the screwed magnetic attractive conjunction mechanism; and which is exemplified as following, in which the flush socket with sector type recessed cylindrical sliding surface 8 of the clip jaw 10 is installed with the sector type prism rotating gripper 11; and the embodiment of the flush socket with sector type recessed cylindrical sliding surface 8 of the clip jaw 10 installed with two sector type prism rotating grippers 101 can be on the analogy, and thus the detail is omitted.

Figure 15:
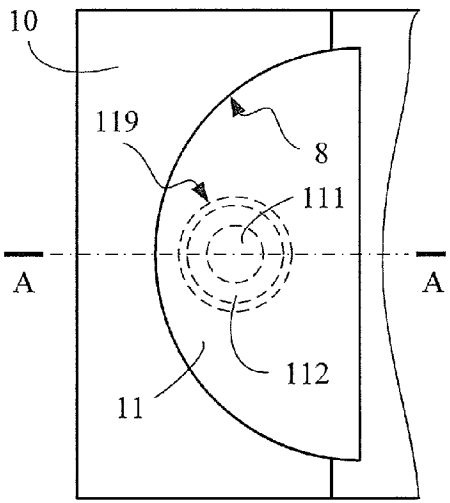
FIG. 15 is a schematic view showing the embodiment of the present invention adopting screwed magnetic attractive conjunction mechanism.

FIG. 15 is a schematic view showing the embodiment of the present invention adopting screwed magnetic attractive conjunction mechanism.

Figure 16:
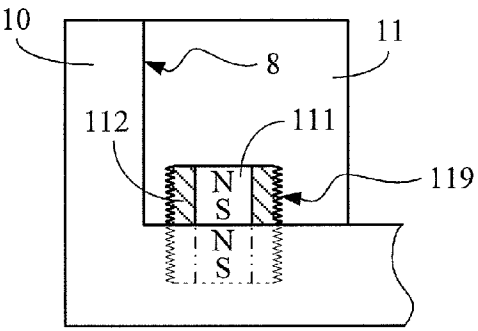
FIG. 16 is the A-A cutaway view of FIG. 15.

FIG. 16 is the A-A cutaway view of FIG. 15.

As shown in FIG. 15 and FIG. 16, in which:

the sector type prism rotating gripper 11 is made of magnetic materials, which is installed in the flush socket with sector type recessed cylindrical sliding surface 8 of the clip jaw 10 to make coaxial rotation, and their cylindrical arc surfaces are sliding and tight contact to form a coupling surface, in which a spiral hole 119 is placed at one or two of the sector type prism rotating gripper 11 and the coupling surface of the flush socket with sector type recessed cylindrical sliding surface 8 of the clip jaw 10, for screwing in the non-magnetizer 112 with external spiral shrouding the magnet 111, to make the sector type prism rotating gripper 11 attract and connect the flush socket with sector type recessed cylindrical sliding surface 8 of the clip jaw 10 after coupling to form a closed magnetic circuit, the magnet 111 shrouded by the non-magnetizer 112 and the coupling surface are parallel and level, and the periphery of the non-magnetizer 112 shrouding the magnet 111 has spiral for screwing in the spiral hole 119 to keep the magnet 111 without interference the magnetic attraction and relative rotation between the both.

If both of the sector type prism rotating gripper and the coupled flush socket with sector type recessed cylindrical sliding surface are installed with magnetic attraction stractures, the maximum attractive force caused from the relative positions between two magnetic attraction stractures with different polarities attraction is used for the positioning function of rotating gripper return.

The magnetic attractive conjunction mechanism of rotating gripper in clamping device further includes an implanted magnetic attractive conjunction mechanism with cover type magnetic circuit, and the implanted magnetic attractive conjunction mechanism with cover type magnetic circuit is installed at one or two of the sector type prism rotating gripper 11 or the flush socket with sector type recessed cylindrical sliding surface 8 of the clip jaw 10, and the materials for installing the sector type prism rotating gripper 11 or the flush socket with sector type recessed cylindrical sliding surface 8 of the clip jaw 10 of the implanted magnetic attractive conjunction mechanism with cover type magnetic circuit are not limited to be magnetic, if the sector type prism rotating gripper 11 or the clip jaw 10, which are relatively coupling, are made of magnetic materials, the both are directly coupling and rotating.

If the sector type prism rotating gripper 11 or the flush socket with sector type recessed cylindrical sliding surface 8 of the clip jaw 10, which are relatively coupling, are made of non-magnetic materials, the closed magnetic circuit is formed by one of the following modes, including: 1) magnetic materials additionally installed at the coupling surface along curved track of relative rotation; or 2) magnetic materials additionally installed at the coupling surface along curved track of relative rotation, and magnetic attractive conjunction mechanism further additionally installed.

If both of the sector type prism rotating gripper and the coupled flush socket with sector type recessed cylindrical sliding surface are installed with magnetic attraction stractures, the maximum attractive force caused from the relative positions between two magnetic attraction stractures with different polarities attraction is used for the positioning function of rotating gripper return.

The sector type prism rotating gripper 11 of the magnetic attractive conjunction mechanism of rotating gripper in clamping device is further made of magnetic or non-magnetic materials, to be installed at the flush socket with sector type recessed cylindrical sliding surface 8 of the clip jaw 10 made of magnetic or non-magnetic materials, for the sector type prism rotating gripper 11 coaxially rotating, and their cylindrical arc surfaces are sliding and tight contact to form a coupling surface, and the shrinkage pool 9 is installed at one or two of the sector type prism rotating gripper 11 and the coupling surface of the flush socket with sector type recessed cylindrical sliding surface 108 of the clip jaw 100, for installing the magnet 111 installed with a cover type magnetic circuit 15, to transmit the line of magnetic force with another polarity of the magnet 111 through the cover type magnetic circuit 15 to the coupling surface to make the both attract and connect each other after coupling to form a closed magnetic circuit.

Figure 17:
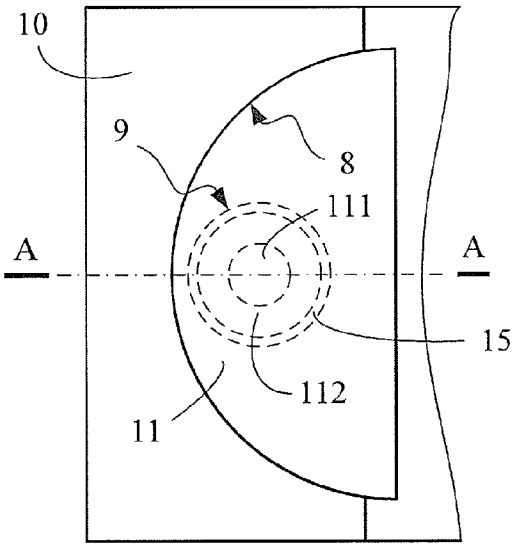
FIG. 17 is a schematic view showing the embodiment of the present invention adopting implanted magnetic attractive conjunction mechanism with cover type magnetic circuit.

FIG. 17 is a schematic view showing the embodiment of the present invention adopting implanted magnetic attractive conjunction mechanism with cover type magnetic circuit.

Figure 18:
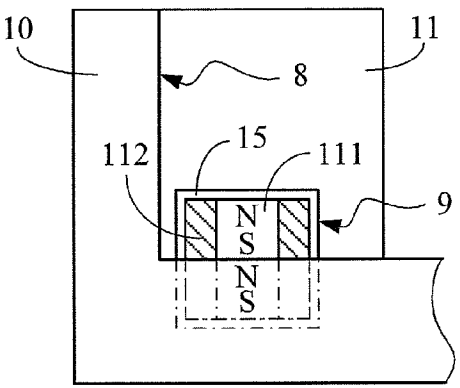
FIG. 18 is the A-A cutaway view of FIG. 17.

FIG. 18 is the A-A cutaway view of FIG. 17.

As shown in FIG. 17 and FIG. 18, for the magnetic attractive conjunction mechanism of rotating gripper in clamping device, the composition materials of the sector type prism rotating gripper 11 and the flush socket with sector type recessed cylindrical sliding surface 8 of the clip jaw 10 are magnetic or non-magnetic, or one is magnetic and another is non-magnetic, and which are constituted through the following modes, in which:

the sector type prism rotating gripper 11 and the flush socket with sector type recessed cylindrical sliding surface 8 of the clip jaw 10 are made of magnetic materials, and the implanted magnetic attractive conjunction mechanism with cover type magnetic circuit is installed at one or two of the sector type prism rotating gripper 11 and the flush socket with sector type recessed cylindrical sliding surface 8 of the clip jaw 10; if the magnetic attractive conjunction mechanisms are installed at the both, which are relatively installed with different polarities;

one of the sector type prism rotating gripper 11 and the flush socket with sector type recessed cylindrical sliding surface 8 of the clip jaw 10 is made of non-magnetic materials, which is constituted through the following modes, in which:

1) the implanted magnetic attractive conjunction mechanism with cover type magnetic circuit is installed at the sector type prism rotating gripper 11 or the rotary coupling surface of the flush socket with sector type recessed cylindrical sliding surface 8 of the clip jaw 10, which is made of magnetic materials, and for another one of the sector type prism rotating gripper 11 or the rotary coupling surface of the flush socket with sector type recessed cylindrical sliding surface 8 of the clip jaw 10, which is made of non-magnetic materials, the magnetic material structure is additionally installed at the coupling surface made of non-magnetic materials, along rotary curved track of the sector type prism rotating gripper 11; or
2) the implanted magnetic attractive conjunction mechanism with cover type magnetic circuit is installed at the sector type prism rotating gripper 11 or the rotary coupling surface of the flush socket with sector type recessed cylindrical sliding surface 8 of the clip jaw 10, which is made of magnetic materials, and for the coupling surface made of non-magnetic materials, the magnetic material structure is additionally installed at the coupling surface made of non-magnetic materials, along rotary curved track of the sector type prism rotating gripper 11, and the implanted magnetic attractive conjunction mechanism with cover type magnetic circuit is also additionally installed; or
3) the implanted magnetic attractive conjunction mechanism with cover type magnetic circuit is installed at the sector type prism rotating gripper 11 or the rotary coupling surface of the flush socket with sector type recessed cylindrical sliding surface 8 of the clip jaw 10, which is made of non-magnetic materials, and which forms a closed magnetic circuit with the sector type prism rotating gripper 11 or the rotary coupling surface of the flush socket with sector type recessed cylindrical sliding surface 8 of the clip jaw 10, which is made of magnetic materials, to produce the attraction and connection function; or
4) the implanted magnetic attractive conjunction mechanism with cover type magnetic circuit is installed at the sector type prism rotating gripper 11 or the rotary coupling surface of the flush socket with sector type recessed cylindrical sliding surface 8 of the clip jaw 10, which is made of non-magnetic materials, and which forms a closed magnetic circuit with the sector type prism rotating gripper 11 or the rotary coupling surface of the flush socket with sector type recessed cylindrical sliding surface 8 of the clip jaw 10, which is made of magnetic materials, to produce the attraction and connection function, and the implanted magnetic attractive conjunction mechanism with cover type magnetic circuit is also additionally installed; or the sector type prism rotating gripper 11 and the flush socket with sector type recessed cylindrical sliding surface 8 of the clip jaw 10 are made of non-magnetic materials, in which:

1) the implanted magnetic attractive conjunction mechanism with cover type magnetic circuit is installed at the coupling surface of one of the sector type prism rotating gripper 11 and the flush socket with sector type recessed cylindrical sliding surface 8 of the clip jaw 10, which are non-magnetic, and the magnetic material structure is additionally installed at the coupling surface of another non-magnetic sector type prism rotating gripper 11 or the flush socket with sector type recessed cylindrical sliding surface 8 of the clip jaw 10, along the relatively rotary curved track; or
2) the implanted magnetic attractive conjunction mechanism with cover type magnetic circuit is installed at the coupling surface of one of the sector type prism rotating gripper 11 and the flush socket with sector type recessed cylindrical sliding surface 8 of the clip jaw 10, which are non-magnetic, and the magnetic material structure is additionally installed at the coupling surface of another non-magnetic sector type prism rotating gripper 11 or the flush socket with sector type recessed cylindrical sliding surface 8 of the clip jaw 10, along the relatively rotary curved track, and the implanted magnetic attractive conjunction mechanism with cover type magnetic circuit is also additionally installed.

The non-magnetizer 112 is installed between the cover type magnetic circuit 15 and the magnet 111, the cover type magnetic circuit 15, the magnet 111 of the non-magnetizer 112 and the coupling surface are parallel and level, and the non-magnetizer 112 is installed between the circumference of the magnet and the shrinkage pool 9 with larger aperture, to keep connection for the structure of the magnet 111 and the shrinkage pool without interference the magnetic attraction and relative rotation between the both; the above-mentioned setting mode includes keeping through structural combination or gluing.

If both of the sector type prism rotating gripper and the coupled flush socket with sector type recessed cylindrical sliding surface are installed with magnetic attraction stractures, the maximum attractive force caused from the relative positions between two magnetic attraction stractures with different polarities attraction is used for the positioning function of rotating gripper return.

Figure 19:
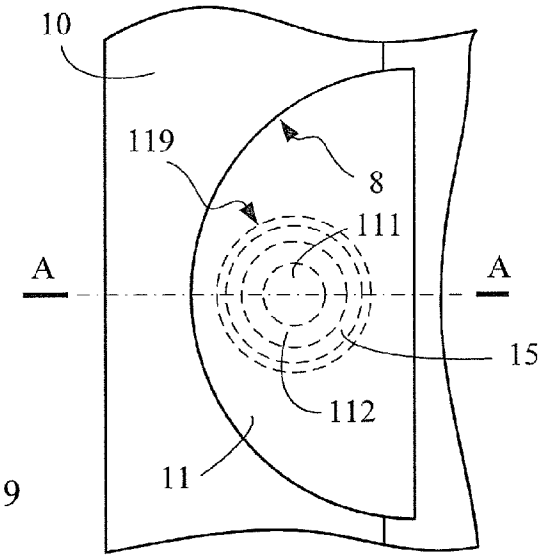
FIG. 19 is a schematic view showing the embodiment of the present invention adopting screwed magnetic attractive conjunction mechanism with cover type magnetic circuit.

FIG. 19 is a schematic view showing the embodiment of the present invention adopting screwed magnetic attractive conjunction mechanism with cover type magnetic circuit.

Figure 20:
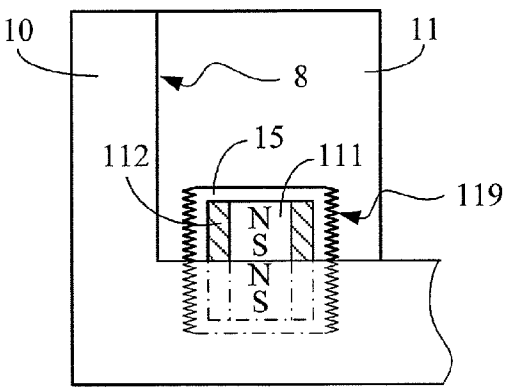
FIG. 20 is the A-A cutaway view of FIG. 19.

FIG. 20 is the A-A cutaway view of FIG. 19.

As shown in FIG. 19 and FIG. 20, in which:

the sector type prism rotating gripper 11 made of magnetic or non-magnetic materials, which is installed in the flush socket with sector type recessed cylindrical sliding surface 8 of the clip jaw 10, which is made of magnetic or non-magnetic materials, to make coaxial relative rotation, and their cylindrical arc surfaces are sliding and tight contact to form a coupling surface, in which the magnetic structure is installed at one or two of the sector type prism rotating gripper 11 and the coupling surface of the flush socket with sector type recessed cylindrical sliding surface 8 of the clip jaw 10, along the sliding arc coupling surface, and the spiral hole 119 is placed at one or two of the both, for screwing in the magnet 111 installed with the cover type magnetic circuit 15, and the screwed magnetic attractive conjunction mechanism with cover type magnetic circuit constituted by the non-magnetizer 112, to make the both attract and connect each other after coupling to form a closed magnetic circuit.

Figure 21:
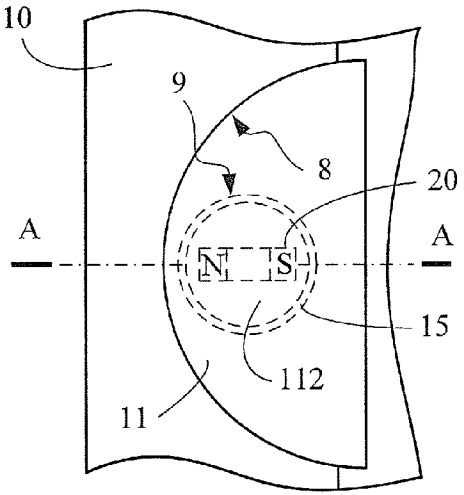
FIG. 21 is a schematic view showing the embodiment of the present invention adopting implanted magnetic attractive conjunction mechanism with horseshoe magnet.

FIG. 21 is a schematic view showing the embodiment of the present invention adopting implanted magnetic attractive conjunction mechanism with horseshoe magnet.

Figure 22:
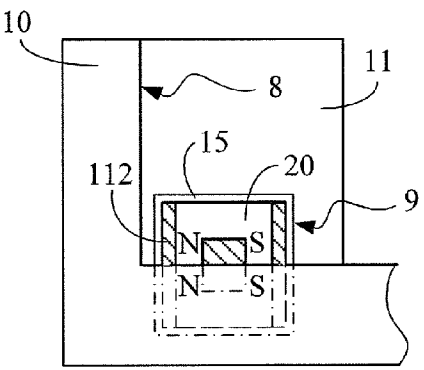
FIG. 22 is the A-A cutaway view of FIG. 21.

FIG. 22 is the A-A cutaway view of FIG. 21.

As shown in FIG. 21 and FIG. 22, in which:

the sector type prism rotating gripper 11 and the flush socket with sector type recessed cylindrical sliding surface 8 of the clip jaw 10 are made of magnetic materials, and the implanted magnetic attractive conjunction mechanism with horseshoe magnet is installed at one or two of the sector type prism rotating gripper 11 and the flush socket with sector type recessed cylindrical sliding surface 8 of the clip jaw 10; if the implanted magnetic attractive conjunction mechanisms with horseshoe magnets are installed at the both, which are relatively installed with different polarities;

one of the sector type prism rotating gripper 11 and the flush socket with sector type recessed cylindrical sliding surface 8 of the clip jaw 10 is made of non-magnetic materials, which is constituted through the following modes, in which:

1) the implanted magnetic attractive conjunction mechanism with horseshoe magnet is installed at the sector type prism rotating gripper 11 or the rotary coupling surface of the flush socket with sector type recessed cylindrical sliding surface 8 of the clip jaw 10, which is made of magnetic materials, and for another one of the sector type prism rotating gripper 11 or the rotary coupling surface of the flush socket with sector type recessed cylindrical sliding surface 8 of the clip jaw 10, which is made of non-magnetic materials, the magnetic material structure is additionally installed at the coupling surface made of non-magnetic materials, along rotary curved track of the sector type prism rotating gripper 11; or
2) the implanted magnetic attractive conjunction mechanism with horseshoe magnet is installed at the sector type prism rotating gripper 11 or the rotary coupling surface of the flush socket with sector type recessed cylindrical sliding surface 8 of the clip jaw 10, which is made of magnetic materials, and for the coupling surface made of non-magnetic materials, the magnetic material structure is additionally installed at the coupling surface made of non-magnetic materials, along rotary curved track of the sector type prism rotating gripper 11, and the implanted magnetic attractive conjunction mechanism with cover type magnetic circuit is also additionally installed; or
3) the implanted magnetic attractive conjunction mechanism with horseshoe magnet is installed at the sector type prism rotating gripper 11 or the rotary coupling surface of the flush socket with sector type recessed cylindrical sliding surface 8 of the clip jaw 10, which is made of non-magnetic materials, and which forms a closed magnetic circuit with the sector type prism rotating gripper 11 or the rotary coupling surface of the flush socket with sector type recessed cylindrical sliding surface 8 of the clip jaw 10, which is made of magnetic materials, to produce the attraction and connection function; or
4) the implanted magnetic attractive conjunction mechanism with horseshoe magnet is installed at the sector type prism rotating gripper 11 or the rotary coupling surface of the flush socket with sector type recessed cylindrical sliding surface 8 of the clip jaw 10, which is made of non-magnetic materials, and which forms a closed magnetic circuit with the sector type prism rotating gripper 11 or the rotary coupling surface of the flush socket with sector type recessed cylindrical sliding surface 8 of the clip jaw 10, which is made of magnetic materials, to produce the attraction and connection function, and the implanted magnetic attractive conjunction mechanism with cover type magnetic circuit is also additionally installed; or the sector type prism rotating gripper 11 and the flush socket with sector type recessed cylindrical sliding surface 8 of the clip jaw 10 are made of non-magnetic materials, in which:

1) the implanted magnetic attractive conjunction mechanism with horseshoe magnet is installed at the coupling surface of one of the sector type prism rotating gripper 11 and the flush socket with sector type recessed cylindrical sliding surface 8 of the clip jaw 10, which are non-magnetic, and the magnetic material structure is additionally installed at the coupling surface of another non-magnetic sector type prism rotating gripper 11 or the flush socket with sector type recessed cylindrical sliding surface 8 of the clip jaw 10, along the relatively rotary curved track; or
2) the implanted magnetic attractive conjunction mechanism with horseshoe magnet is installed at the coupling surface of one of the sector type prism rotating gripper 11 and the flush socket with sector type recessed cylindrical sliding surface 8 of the clip jaw 10, which are non-magnetic, and the magnetic material structure is additionally installed at the coupling surface of another non-magnetic sector type prism rotating gripper 11 or the flush socket with sector type recessed cylindrical sliding surface 8 of the clip jaw 10, along the relatively rotary curved track, and the implanted magnetic attractive conjunction mechanism with cover type magnetic circuit is also additionally installed.

The non-magnetizer 112 shrouding a horseshoe magnet 20, the horseshoe magnet 20 and the coupling surface are parallel and level, and the non-magnetizer 112 is installed between the periphery of the magnet and the shrinkage pool 9 with larger aperture, to keep connection for the structure of the horseshoe magnet 20 and the shrinkage pool without interference the magnetic attraction and relative rotation between the both; the above-mentioned setting mode includes keeping through structural combination or gluing.

If both of the sector type prism rotating gripper and the coupled flush socket with sector type recessed cylindrical sliding surface are installed with magnetic attraction stractures, the maximum attractive force caused from the relative positions between two magnetic attraction stractures with different polarities attraction is used for the positioning function of rotating gripper return.

Figure 23:
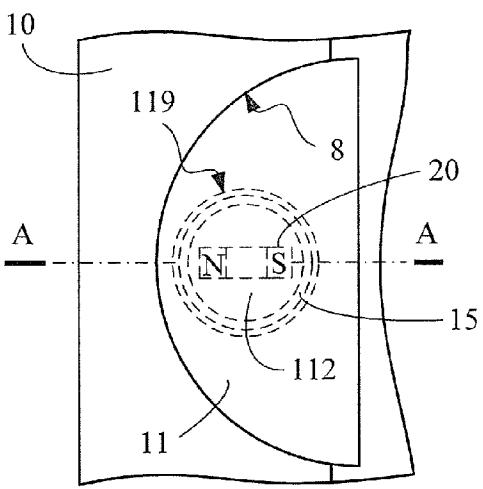
FIG. 23 is a schematic view showing the embodiment of the present invention adopting screwed magnetic attractive conjunction mechanism with horseshoe magnet.

FIG. 23 is a schematic view showing the embodiment of the present invention adopting screwed magnetic attractive conjunction mechanism with horseshoe magnet.

Figure 24:
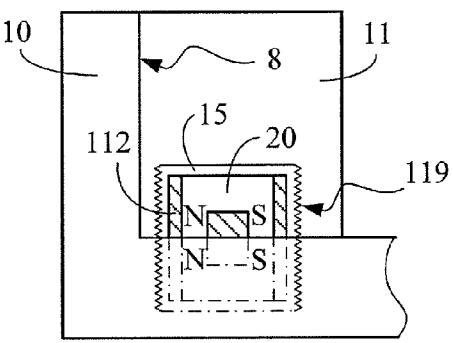
FIG. 24 is the A-A cutaway view of FIG. 23.

FIG. 24 is the A-A cutaway view of FIG. 23.

As shown in FIG. 23 and FIG. 24, in which:

the sector type prism rotating gripper 11 made of magnetic or non-magnetic materials, which is installed in the flush socket with sector type recessed cylindrical sliding surface 8 of the clip jaw 10, which is made of magnetic or non-magnetic materials, to make coaxial relative rotation, and their cylindrical arc surfaces are sliding and tight contact to form a coupling surface, in which the magnetic structure is installed at one or two of the sector type prism rotating gripper 11 and the coupling surface of the flush socket with sector type recessed cylindrical sliding surface 8 of the clip jaw 10, along the sliding arc coupling surface, and the spiral hole 119 is placed at one or two of the both, for screwing in the screwed magnetic attractive conjunction mechanism with the horseshoe magnet, which is installed with the horseshoe magnet 20 and the non-magnetizer 112, to make the both attract and connect each other after coupling to form a closed magnetic circuit.

The invention claimed is:

1. A magnetic attractive conjunction mechanism of rotating gripper in clamping device, in which the magnetic attractive conjunction mechanism is installed at one or two of the sector type prism rotating gripper and the flush socket with sector type recessed cylindrical sliding surface of the coupled clip jaw, to make the sector type prism rotating gripper attract and connect to the flush socket with sector type recessed cylindrical sliding surface of the clip jaw through magnetic force, so as to form rotary coupling which prevents from detachment and is easily removed for cleaning and maintenance, and the main components are as following:

a sector type prism rotating gripper (11), which is installed in a flush socket with sector type recessed cylindrical sliding surface (8) of a clip jaw (10) to make coaxial relative rotation, and their cylindrical arc surfaces are sliding and tight contact to form a coupling surface, in which a shrinkage pool (9) is installed at one or two of the sector type prism rotating gripper (11) and the coupling surface of the flush socket with sector type recessed cylindrical sliding surface (8) of the clip jaw (10), for installing a magnet (111) to make the both attract and connect each other after coupling to form a closed magnetic circuit, and the magnet and the coupling surface are parallel and level, and a non-magnetizer (112) is installed between the circumference of the magnet and the shrinkage pool (9) with larger aperture, to keep connection for the structure of the magnet and the shrinkage pool without interference the magnetic attraction and relative rotation between the both; the above-mentioned setting mode includes keeping through structural combination or gluing.

2. The magnetic attractive conjunction mechanism of rotating gripper in clamping device as claimed in claim 1, in which the materials for installing the sector type prism rotating gripper (11) of the magnetic attractive conjunction mechanism or the flush socket with sector type recessed cylindrical sliding surface (8) of the clip jaw (10) are not limited to be magnetic, if the sector type prism rotating gripper (11) or the flush socket with sector type recessed cylindrical sliding surface (8) of the clip jaw (10), which are relatively coupling, are made of magnetic materials, the both are directly coupling and rotating.

3. The magnetic attractive conjunction mechanism of rotating gripper in clamping device as claimed in claim 1, in which the materials for installing the sector type prism rotating gripper (11) of the magnetic attractive conjunction mechanism or the flush socket with sector type recessed cylindrical sliding surface (8) of the clip jaw (10) are not limited to be magnetic, if the sector type prism rotating gripper (11) or the flush socket with sector type recessed cylindrical sliding surface (8) of the clip jaw (10), which are relatively coupling, are made of non-magnetic materials, the closed magnetic circuit is formed by one of the following modes, including: 1) magnetic materials additionally installed at the coupling surface along curved track of relative rotation; or 2) magnetic materials additionally installed at the coupling surface along curved track of relative rotation, and magnetic attractive conjunction mechanism further additionally installed.

4. The magnetic attractive conjunction mechanism of rotating gripper in clamping device as claimed in claim 1, in which the flush socket with sector type recessed cylindrical sliding surface in the clip jaw is installed with two sector type cylinder-shaped rotating grippers, wherein:

two sector type prism rotating grippers (101) with same radius but same or different included angles are made of magnetic materials, in which the bottom has recessed oblique arc surface, two sector type prism rotating grippers (101) are installed at the same flush socket (108) of the clip jaw (100) with sector type recessed cylindrical sliding surface, which is made of magnetic materials, for coaxial rotary, the bottom of the flush socket with sector type recessed cylindrical sliding surface (108) of the clip jaw (100) also has recessed oblique surface, coordinating with the recessed oblique arc surface of the bottom of the sector type prism rotating gripper (101), to form oblique coupling arc surface, and their cylindrical arc surfaces are sliding and tight contact to form a coupling surface, and the shrinkage pool (109) is installed at one or two of the two sector type prism rotating grippers (101) and the oblique coupling arc surface of the flush socket with sector type recessed cylindrical sliding surface (108) of the clip jaw (100), for installing the magnet (111) to make the both attract and connect each other after coupling to form a closed magnetic circuit, and the magnet and the coupling arc surface are parallel and level, and the non-magnetizer (112) is installed between the circumference of the magnet and the shrinkage pool (109) with larger aperture, to keep connection for the structure of the magnet and the shrinkage pool without interference the magnetic attraction and relative rotation between the both; the above-mentioned setting mode includes keeping through structural combination or gluing.

5. The magnetic attractive conjunction mechanism of rotating gripper in clamping device as claimed in claim 1, in which the flush socket with sector type recessed cylindrical sliding surface in the clip jaw is installed with two sector type cylinder-shaped rotating grippers, wherein:

two sector type prism rotating grippers (101) with same radius but same or different included angles are made of magnetic materials, in which the backside has arc surface, two sector type prism rotating grippers (101) are installed at the same flush socket (108) of the clip jaw (100) with sector type recessed cylindrical sliding surface, which is made of magnetic materials, for coaxial rotary, and their cylindrical arc surfaces are sliding and tight contact to form a coupling surface, and the shrinkage pool (109) is installed at one or two of the backside arc surfaces of the two sector type prism rotating grippers (101) and the oblique coupling arc surface of the flush socket with sector type recessed cylindrical sliding surface (108) of the clip jaw (100), for installing the magnet (111) to make the both attract and connect each other after coupling to form a closed magnetic circuit, and the magnet and the coupling arc surface are parallel and level, and the non-magnetizer (112) is installed between the circumference of the magnet and the shrinkage pool (109) with larger aperture, to keep connection for the structure of the magnet and the shrinkage pool without interference the magnetic attraction and relative rotation between the both; the above-mentioned setting mode includes keeping through structural combination or gluing.

6. The magnetic attractive conjunction mechanism of rotating gripper in clamping device as claimed in claim 1, in which the flush socket with sector type recessed cylindrical sliding surface in the clip jaw is installed with two sector type cylinder-shaped rotating grippers, wherein:

two sector type prism rotating grippers (101) with same radius but same or different included angles are made of magnetic materials, in which two sector type prism rotating grippers (101) are installed at the same flush socket (108) of the clip jaw (100) with sector type recessed cylindrical sliding surface, which is made of magnetic materials, for coaxial rotary, and their cylindrical arc surfaces are sliding and tight contact to form a coupling surface, and the shrinkage pool (109) is installed at one or two of the coupling surfaces of the two sector type prism rotating grippers (101) and the coupling surface of the flush socket with sector type recessed cylindrical sliding surface (108) of the clip jaw (100), for installing the magnet (111) to make the both attract and connect each other after coupling to form a closed magnetic circuit, and the magnet and the coupling arc surface are parallel and level, and the non-magnetizer (112) is installed between the circumference of the magnet and the shrinkage pool (109) with larger aperture, to keep connection for the structure of the magnet and the shrinkage pool without interference the magnetic attraction and relative rotation between the both; the above-mentioned setting mode includes keeping through structural combination or gluing.

7. The magnetic attractive conjunction mechanism of rotating gripper in clamping device as claimed in claim 1, in which the clip jaw has two flush sockets with sector type recessed cylindrical sliding surfaces, and each flush socket with sector type recessed cylindrical sliding surface is individually installed with a sector type cylinder-shaped rotating gripper, wherein:

the clip jaw has two flush sockets with sector type recessed cylindrical sliding surfaces, and each flush socket with sector type recessed cylindrical sliding surface is individually installed with a sector type cylinder-shaped rotating gripper, and the sector type prism rotating gripper (101) is made of magnetic materials, in which the bottom has recessed oblique arc surface, the sector type prism rotating gripper (101) is installed at the flush socket with sector type recessed cylindrical sliding surface (108) of the clip jaw (100), which is made of magnetic materials, for coaxial rotary, the bottom of the flush socket with sector type recessed cylindrical sliding surface 108 of the clip jaw (100) also has recessed oblique surface, coordinating with the recessed oblique arc surface of the bottom of the sector type prism rotating gripper (101), to form oblique coupling arc surface, and their cylindrical arc surfaces are sliding and tight contact to form a coupling surface, and the shrinkage pool (109) is installed at one or two of the sector type prism rotating gripper (101) and the oblique coupling arc surface of the flush socket with sector type recessed cylindrical sliding surface (108) of the clip jaw (100), for installing the magnet (111) to make the both attract and connect each other after coupling to form a closed magnetic circuit, and the magnet and the coupling arc surface are parallel and level, and the non-magnetizer (112) is installed between the circumference of the magnet and the shrinkage pool (109) with larger aperture, to keep connection for the structure of the magnet and the shrinkage pool without interference the magnetic attraction and relative rotation between the both; the above-mentioned setting mode includes keeping through structural combination or gluing.

8. The magnetic attractive conjunction mechanism of rotating gripper in clamping device as claimed in claim 1, in which the clip jaw has two flush sockets with sector type recessed cylindrical sliding surfaces, and each flush socket with sector type recessed cylindrical sliding surface is individually installed with a sector type cylinder-shaped rotating gripper, wherein:

the clip jaw has two flush sockets with sector type recessed cylindrical sliding surfaces, and each flush socket with sector type recessed cylindrical sliding surface is individually installed with a sector type cylinder-shaped rotating gripper, and the sector type prism rotating gripper (101) is made of magnetic materials, in which the backside has arc surface, the sector type prism rotating gripper (101) is installed at the flush socket with sector type recessed cylindrical sliding surface (108) of the clip jaw (100), which is made of magnetic materials, for coaxial rotary, and their cylindrical arc surfaces are sliding and tight contact to form a coupling surface, and the shrinkage pool (109) is installed at one or two of the backside arc surface of the sector type prism rotating gripper (101) and the coupling arc surface of the flush socket with sector type recessed cylindrical sliding surface (108) of the clip jaw (100), for installing the magnet (111) to make the both attract and connect each other after coupling to form a closed magnetic circuit, and the magnet and the coupling arc surface are parallel and level, and the non-magnetizer (112) is installed between the circumference of the magnet and the shrinkage pool (109) with larger aperture, to keep connection for the structure of the magnet and the shrinkage pool without interference the magnetic attraction and relative rotation between the both; the above-mentioned setting mode includes keeping through structural combination or gluing.

9. The magnetic attractive conjunction mechanism of rotating gripper in clamping device as claimed in claim 1, in which the clip jaw has two flush sockets with sector type recessed cylindrical sliding surfaces, and each flush socket with sector type recessed cylindrical sliding surface is individually installed with a sector type cylinder-shaped rotating gripper, wherein:

the clip jaw has two flush sockets with sector type recessed cylindrical sliding surfaces, and each flush socket with sector type recessed cylindrical sliding surface is individually installed with a sector type cylinder-shaped rotating gripper, and the sector type prism rotating gripper (101) is made of magnetic materials, in which the sector type prism rotating gripper (101) is installed at the flush socket with sector type recessed cylindrical sliding surface (108) of the clip jaw (100), which is made of magnetic materials, for coaxial rotary, and their cylindrical arc surfaces are sliding and tight contact to form a coupling surface, and the shrinkage pool (109) is installed at one or two of the coupling surface of the bottom of the sector type prism rotating gripper (101) and the coupling surface of the flush socket with sector type recessed cylindrical sliding surface (108) of the clip jaw (100), for installing the magnet (111) to make the both attract and connect each other after coupling to form a closed magnetic circuit, and the magnet and the coupling arc surface are parallel and level, and the non-magnetizer (112) is installed between the circumference of the magnet and the shrinkage pool (109) with larger aperture, to keep connection for the structure of the magnet and the shrinkage pool without interference the magnetic attraction and relative rotation between the both; the above-mentioned setting mode includes keeping through structural combination or gluing.

10. The magnetic attractive conjunction mechanism of rotating gripper in clamping device as claimed in claim 1, in which the magnetic attractive conjunction mechanism for the sector type prism rotating gripper (11) attracting and connecting the flush socket with sector type recessed cylindrical sliding surface (8) of the clip jaw (10) is further constituted by the screwed magnetic attractive conjunction mechanism, wherein:

the sector type prism rotating gripper (11) is made of magnetic materials, which is installed in the flush socket with sector type recessed cylindrical sliding surface (8) of the clip jaw (10) to make coaxial rotation, and their cylindrical arc surfaces are sliding and tight contact to form a coupling surface, in which a spiral hole (119) is placed at one or two of the sector type prism rotating gripper (11) and the coupling surface of the flush socket with sector type recessed cylindrical sliding surface (8) of the clip jaw (10), for screwing in the non-magnetizer (112) with external spiral shrouding the magnet (111), to make the sector type prism rotating gripper (11) attract and connect the flush socket with sector type recessed cylindrical sliding surface (8) of the clip jaw (10) after coupling to form a closed magnetic circuit, the magnet (111) shrouded by the non-magnetizer (112) and the coupling surface are parallel and level, and the periphery of the non-magnetizer (112) shrouding the magnet (111) has spiral for screwing in the spiral hole (119) to keep the magnet (111) without interference the magnetic attraction and relative rotation between the both.

11. The magnetic attractive conjunction mechanism of rotating gripper in clamping device as claimed in claim 1, further including an implanted magnetic attractive conjunction mechanism with cover type magnetic circuit, in which the implanted magnetic attractive conjunction mechanism with cover type magnetic circuit is installed at one or two of the sector type prism rotating gripper (11) or the flush socket with sector type recessed cylindrical sliding surface (8) of the clip jaw (10), and the materials for installing the sector type prism rotating gripper (11) or the flush socket with sector type recessed cylindrical sliding surface (8) of the clip jaw (10) of the implanted magnetic attractive conjunction mechanism with cover type magnetic circuit are not limited to be magnetic, if the sector type prism rotating gripper (11) or the clip jaw (10), which are relatively coupling, are made of magnetic materials, the both are directly coupling and rotating.

12. The magnetic attractive conjunction mechanism of rotating gripper in clamping device as claimed in claim 11, in which if the sector type prism rotating gripper (11) or the flush socket with sector type recessed cylindrical sliding surface (8) of the clip jaw (10), which are relatively coupling, are made of non-magnetic materials, the closed magnetic circuit is formed by one of the following modes, including: 1) magnetic materials additionally installed at the coupling surface along curved track of relative rotation; or 2) magnetic materials additionally installed at the coupling surface along curved track of relative rotation, and magnetic attractive conjunction mechanism further additionally installed.

13. The magnetic attractive conjunction mechanism of rotating gripper in clamping device as claimed in claim 11, in which the sector type prism rotating gripper (11) of the magnetic attractive conjunction mechanism of rotating gripper in clamping device is further made of magnetic or non-magnetic materials, to be installed at the flush socket with sector type recessed cylindrical sliding surface (8) of the clip jaw (10) made of magnetic or non-magnetic materials, for the sector type prism rotating gripper (11) coaxially rotating, and their cylindrical arc surfaces are sliding and tight contact to form a coupling surface, and the shrinkage pool (9) is installed at one or two of the sector type prism rotating gripper (11) and the coupling surface of the flush socket with sector type recessed cylindrical sliding surface (8) of the clip jaw (10), for installing the magnet (111) installed with a cover type magnetic circuit (15), to transmit the line of magnetic force with another polarity of the magnet (111) through the cover type magnetic circuit (15) to the coupling surface to make the both attract and connect each other after coupling to form a closed magnetic circuit.

14. The magnetic attractive conjunction mechanism of rotating gripper in clamping device as claimed in claim 11, in which the composition materials of the sector type prism rotating gripper (11) and the flush socket with sector type recessed cylindrical sliding surface (8) of the clip jaw (10) are magnetic or non-magnetic, or one is magnetic and another is non-magnetic, and which are constituted through the following modes, wherein:

the sector type prism rotating gripper (11) and the flush socket with sector type recessed cylindrical sliding surface (8) of the clip jaw (10) are made of magnetic materials, and the implanted magnetic attractive conjunction mechanism with cover type magnetic circuit is installed at one or two of the sector type prism rotating gripper (11) and the flush socket with sector type recessed cylindrical sliding surface (8) of the clip jaw (10); if the magnetic attractive conjunction mechanisms are installed at the both, which are relatively installed with different polarities;

one of the sector type prism rotating gripper (11) and the flush socket with sector type recessed cylindrical sliding surface (8) of the clip jaw (10) is made of non-magnetic materials, which is constituted through the following modes, in which:

1) the implanted magnetic attractive conjunction mechanism with cover type magnetic circuit is installed at the sector type prism rotating gripper (11) or the rotary coupling surface of the flush socket with sector type recessed cylindrical sliding surface (8) of the clip jaw (10), which is made of magnetic materials, and for another one of the sector type prism rotating gripper (11) or the rotary coupling surface of the flush socket with sector type recessed cylindrical sliding surface (8) of the clip jaw (10), which is made of non-magnetic materials, the magnetic material structure is additionally installed at the coupling surface made of non-magnetic materials, along rotary curved track of the sector type prism rotating gripper (11); or 2) the implanted magnetic attractive conjunction mechanism with cover type magnetic circuit is installed at the sector type prism rotating gripper (11) or the rotary coupling surface of the flush socket with sector type recessed cylindrical sliding surface (8) of the clip jaw (10), which is made of magnetic materials, and for the coupling surface made of non-magnetic materials, the magnetic material structure is additionally installed at the coupling surface made of non-magnetic materials, along rotary curved track of the sector type prism rotating gripper (11), and the implanted magnetic attractive conjunction mechanism with cover type magnetic circuit is also additionally installed; or 3) the implanted magnetic attractive conjunction mechanism with cover type magnetic circuit is installed at the sector type prism rotating gripper (11) or the rotary coupling surface of the flush socket with sector type recessed cylindrical sliding surface (8) of the clip jaw (10), which is made of non-magnetic materials, and which forms a closed magnetic circuit with the sector type prism rotating gripper (11) or the rotary coupling surface of the flush socket with sector type recessed cylindrical sliding surface (8) of the clip jaw (10), which is made of magnetic materials, to produce the attraction and connection function; or 4) the implanted magnetic attractive conjunction mechanism with cover type magnetic circuit is installed at the sector type prism rotating gripper (11) or the rotary coupling surface of the flush socket with sector type recessed cylindrical sliding surface (8) of the clip jaw (10), which is made of non-magnetic materials, and which forms a closed magnetic circuit with the sector type prism rotating gripper (11) or the rotary coupling surface of the flush socket with sector type recessed cylindrical sliding surface (8) of the clip jaw (10), which is made of magnetic materials, to produce the attraction and connection function, and the implanted magnetic attractive conjunction mechanism with cover type magnetic circuit is also additionally installed; or the sector type prism rotating gripper (11) and the flush socket with sector type recessed cylindrical sliding surface (8) of the clip jaw (10) are made of non-magnetic materials, in which:

1) the implanted magnetic attractive conjunction mechanism with cover type magnetic circuit is installed at the coupling surface of one of the sector type prism rotating gripper (11) and the flush socket with sector type recessed cylindrical sliding surface (8) of the clip jaw (10), which are non-magnetic, and the magnetic material structure is additionally installed at the coupling surface of another non-magnetic sector type prism rotating gripper (11) or the flush socket with sector type recessed cylindrical sliding surface (8) of the clip jaw (10), along the relatively rotary curved track; or 2) the implanted magnetic attractive conjunction mechanism with cover type magnetic circuit is installed at the coupling surface of one of the sector type prism rotating gripper (11) and the flush socket with sector type recessed cylindrical sliding surface (8) of the clip jaw (10), which are non-magnetic, and the magnetic material structure is additionally installed at the coupling surface of another non-magnetic sector type prism rotating gripper (11) or the flush socket with sector type recessed cylindrical sliding surface (8) of the clip jaw (10), along the relatively rotary curved track, and the implanted magnetic attractive conjunction mechanism with cover type magnetic circuit is also additionally installed;

the non-magnetizer (112) is installed between the cover type magnetic circuit (15) and the magnet (111), the cover type magnetic circuit (15), the magnet (111) of the non-magnetizer (112) and the coupling surface are parallel and level, and the non-magnetizer (112) is installed between the circumference of the magnet and the shrinkage pool (9) with larger aperture, to keep connection for the structure of the magnet (111) and the shrinkage pool without interference the magnetic attraction and relative rotation between the both; the above-mentioned setting mode includes keeping through structural combination or gluing.

15. The magnetic attractive conjunction mechanism of rotating gripper in clamping device as claimed in claim 11, in which:

the sector type prism rotating gripper (11) made of magnetic or non-magnetic materials, which is installed in the flush socket with sector type recessed cylindrical sliding surface (8) of the clip jaw (10), which is made of magnetic or non-magnetic materials, to make coaxial relative rotation, and their cylindrical arc surfaces are sliding and tight contact to form a coupling surface, in which the magnetic structure is installed at one or two of the sector type prism rotating gripper (11) and the coupling surface of the flush socket with sector type recessed cylindrical sliding surface (8) of the clip jaw (10), along the sliding arc coupling surface, and the spiral hole (119) is placed at one or two of the both, for screwing in the magnet (111) installed with the cover type magnetic circuit (15), and the screwed magnetic attractive conjunction mechanism with cover type magnetic circuit constituted by the non-magnetizer (112), to make the both attract and connect each other after coupling to form a closed magnetic circuit.

16. The magnetic attractive conjunction mechanism of rotating gripper in clamping device as claimed in claim 1, including implanted magnetic attractive conjunction mechanism with horseshoe magnet, in which:

the sector type prism rotating gripper (11) and the flush socket with sector type recessed cylindrical sliding surface (8) of the clip jaw (10) are made of magnetic materials, and the implanted magnetic attractive conjunction mechanism with horseshoe magnet is installed at one or two of the sector type prism rotating gripper (11) and the flush socket with sector type recessed cylindrical sliding surface (8) of the clip jaw (10); if the implanted magnetic attractive conjunction mechanisms with horseshoe magnets are installed at the both, which are relatively installed with different polarities;

one of the sector type prism rotating gripper (11) and the flush socket with sector type recessed cylindrical sliding surface (8) of the clip jaw (10) is made of non-magnetic materials, which is constituted through the following modes, in which:

1) the implanted magnetic attractive conjunction mechanism with horseshoe magnet is installed at the sector type prism rotating gripper (11) or the rotary coupling surface of the flush socket with sector type recessed cylindrical sliding surface (8) of the clip jaw (10), which is made of magnetic materials, and for another one of the sector type prism rotating gripper (11) or the rotary coupling surface of the flush socket with sector type recessed cylindrical sliding surface (8) of the clip jaw (10), which is made of non-magnetic materials, the magnetic material structure is additionally installed at the coupling surface made of non-magnetic materials, along rotary curved track of the sector type prism rotating gripper (11); or 2) the implanted magnetic attractive conjunction mechanism with horseshoe magnet is installed at the sector type prism rotating gripper (11) or the rotary coupling surface of the flush socket with sector type recessed cylindrical sliding surface (8) of the clip jaw (10), which is made of magnetic materials, and for the coupling surface made of non-magnetic materials, the magnetic material structure is additionally installed at the coupling surface made of non-magnetic materials, along rotary curved track of the sector type prism rotating gripper (11), and the implanted magnetic attractive conjunction mechanism with cover type magnetic circuit is also additionally installed; or 3) the implanted magnetic attractive conjunction mechanism with horseshoe magnet is installed at the sector type prism rotating gripper (11) or the rotary coupling surface of the flush socket with sector type recessed cylindrical sliding surface (8) of the clip jaw (10), which is made of non-magnetic materials, and which forms a closed magnetic circuit with the sector type prism rotating gripper (11) or the rotary coupling surface of the flush socket with sector type recessed cylindrical sliding surface (8) of the clip jaw (10), which is made of magnetic materials, to produce the attraction and connection function; or 4) the implanted magnetic attractive conjunction mechanism with horseshoe magnet is installed at the sector type prism rotating gripper (11) or the rotary coupling surface of the flush socket with sector type recessed cylindrical sliding surface (8) of the clip jaw (10), which is made of non-magnetic materials, and which forms a closed magnetic circuit with the sector type prism rotating gripper (11) or the rotary coupling surface of the flush socket with sector type recessed cylindrical sliding surface (8) of the clip jaw (10), which is made of magnetic materials, to produce the attraction and connection function, and the implanted magnetic attractive conjunction mechanism with cover type magnetic circuit is also additionally installed; or the sector type prism rotating gripper (11) and the flush socket with sector type recessed cylindrical sliding surface (8) of the clip jaw (10) are made of non-magnetic materials, in which:

1) the implanted magnetic attractive conjunction mechanism with horseshoe magnet is installed at the coupling surface of one of the sector type prism rotating gripper (11) and the flush socket with sector type recessed cylindrical sliding surface (8) of the clip jaw (10), which are non-magnetic, and the magnetic material structure is additionally installed at the coupling surface of another non-magnetic sector type prism rotating gripper (11) or the flush socket with sector type recessed cylindrical sliding surface (8) of the clip jaw (10), along the relatively rotary curved track; or 2) the implanted magnetic attractive conjunction mechanism with horseshoe magnet is installed at the coupling surface of one of the sector type prism rotating gripper (11) and the flush socket with sector type recessed cylindrical sliding surface (8) of the clip jaw (10), which are non-magnetic, and the magnetic material structure is additionally installed at the coupling surface of another non-magnetic sector type prism rotating gripper (11) or the flush socket with sector type recessed cylindrical sliding surface (8) of the clip jaw (10), along the relatively rotary curved track, and the implanted magnetic attractive conjunction mechanism with cover type magnetic circuit is also additionally installed;

the non-magnetizer (112) shrouding a horseshoe magnet (20), the horseshoe magnet (20) and the coupling surface are parallel and level, and the non-magnetizer (112) is installed between the periphery of the magnet and the shrinkage pool (9) with larger aperture, to keep connection for the structure of the horseshoe magnet (20) and the shrinkage pool without interference the magnetic attraction and relative rotation between the both; the above-mentioned setting mode includes keeping through structural combination or gluing.

17. The magnetic attractive conjunction mechanism of rotating gripper in clamping device as claimed in claims 1, 4, 5, 6, 7, 8, 9, 10, 11, 12, 13, 14, 15 or 16, in which if both of the sector type prism rotating gripper and the coupled flush socket with sector type recessed cylindrical sliding surface are installed with magnetic attraction stractures, the maximum attractive force caused from the relative positions between two magnetic attraction stractures with different polarities attraction is used for the positioning function of rotating gripper return.

18. The magnetic attractive conjunction mechanism of rotating gripper in clamping device as claimed in claim 1, in which:

the sector type prism rotating gripper (11) made of magnetic or non-magnetic materials, which is installed in the flush socket with sector type recessed cylindrical sliding surface (8) of the clip jaw (10), which is made of magnetic or non-magnetic materials, to make coaxial relative rotation, and their cylindrical arc surfaces are sliding and tight contact to form a coupling surface, in which the magnetic structure is installed at one or two of the sector type prism rotating gripper (11) and the coupling surface of the flush socket with sector type recessed cylindrical sliding surface (8) of the clip jaw (10), along the sliding arc coupling surface, and the spiral hole (119) is placed at one or two of the both, for screwing in the screwed magnetic attractive conjunction mechanism with the horseshoe magnet, which is installed with the horseshoe magnet (20) and the non-magnetizer (112), to make the both attract and connect each other after coupling to form a closed magnetic circuit.

* * * * *